US005567069A

United States Patent [19]

Suzuki et al.

[11] Patent Number: 5,567,069

[45] Date of Patent: Oct. 22, 1996

[54] RECORDING MEDIUM TRANSPORT MECHANISM AND INK JET RECORDING APPARATUS USING THE MECHANISM

[75] Inventors: Tetsuo Suzuki, Yokohama; Masahiro Taniguro, Ushiku; Hiroyuki Saito, Yokohama; Koichi Tanno, Kawasaki; Haruyuki Yanagi, Machida; Makoto Kawarama, Ayase; Hiroyuki Kinoshita, Kawasaki; Masaya Shinmachi, Kawasaki; Tan A. Ming, Kawasaki, all of Japan

[73] Assignee: Canon Kabushiki Kaisha, Tokyo, Japan

[21] Appl. No.: 376,746

[22] Filed: Jan. 23, 1995

[30] Foreign Application Priority Data

Jan. 25, 1994 [JP] Japan ..... 6-006595
Jan. 18, 1995 [JP] Japan ..... 7-005550

[51] Int. Cl.[6] ..... B41J 13/076

[52] U.S. Cl. ..... 400/636; 400/641; 492/27; 492/30

[58] Field of Search ..... 400/634, 636, 400/641; 101/425; 492/24, 25, 29, 30, 53; 347/105, 106

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al. .
4,558,333 12/1985 Sugitani et al. .
4,723,129 2/1988 Endo et al. .
4,740,796 4/1988 Endo et al. .
5,291,224 3/1994 Asano et al. .

FOREIGN PATENT DOCUMENTS 59-123670 7/1984 Japan .
59-138461 8/1984 Japan .
61-206676 9/1986 Japan .
61-051999 11/1986 Japan .
1226379 11/1989 Japan .
3142247 6/1991 Japan .

*Primary Examiner*—John S. Hilten
*Attorney, Agent, or Firm*—Fitzpatrick, Cella, Harper & Scinto

[57] ABSTRACT

A recording medium transport mechanism has first rotary members provided downstream of a recording area in the direction of transport of a recording medium and on the side of a recording surface of the recording medium, and a second rotary member provided downstream of the recording area and on the side opposite from the recording surface side of the recording medium to guide the recording medium in association with the first rotary members to discharge the recording medium out of the recording area, the second rotary member including a liquid absorbing member provided on its circumferential surface portions and capable of contacting the first rotary members. This recording medium transport mechanism is used in an ink jet recording apparatus to prevent a contamination on the surface of a recording medium opposite from the recording surface side.

28 Claims, 8 Drawing Sheets

RECORDING MEDIUM TRANSPORT MECHANISM AND INK JET RECORDING APPARATUS USING THE MECHANISM

BACKGROUND OF THE INVENTION

1. Field of the Invention

This invention relates to an ink jet recording apparatus which performs recording by ejecting ink to a recording medium and, more particularly, to a recording medium transport mechanism capable of preventing, for a long period of time, re-transfer of ink to the recording medium caused by a rotary discharge member for discharging the recording medium after recording and a following rotary member which contacts the rotary discharge member, and also to an ink jet recording apparatus using the recording medium transport mechanism.

2. Description of the Related Art

Conventionally, recording apparatuses such as printers, copying machines and facsimile machines are arranged so that an energy generating meter of a recording head is driven in accordance with image information transmitted to the apparatus to record an image formed of dot patterns on a recording sheet such as a sheet of paper or a thin plastic plate. Recording apparatuses using an ink jet system, i.e., ink jet recording apparatuses, among such recording apparatuses, perform recording by ejecting ink from a recording head onto a recording member, and are advantageous because they can easily be designed so as to be smaller in size, can record an image with accuracy at a high speed, can record an image on plain paper without any special pretreatment, can be used at a small running cost, can operate with reduced noise since they are of a non-impact type, and can easily be designed to record a multi-color image by using multiple color inks. In particular, it is possible to further increase the recording speed of line type ink jet recording apparatuses having a line type recording head in which a multiplicity of ink ejection outlets are arranged in the direction of the recording sheet width.

However, since ink jet recording apparatuses perform recording by ejecting ink to a recording member, ink on a recording member cannot dry easily in the case of high-density recording or recording under high-temperature and high-humidity conditions. In such a situation, a roller on the recording surface side in a pair of discharge rollers positioned downstream of a recording section may be contaminated with ink, and the ink may be again transferred to the recording medium to contaminate the recording surface. A method for solving this method, such as that described in Japanese Patent Publication No. 51999/1986 or Japanese Laid-Open Patent application No. 142247/1991, is known in which a cleaner member is brought into contact with the roller on the recording surface side in a pair of discharge rollers positioned downstream of a recording section to remove ink attached to the roller surface, whereby re-transfer of ink to the recording medium is prevented. In particular, in conventional ink jet recording apparatuses, it is necessary to minimize such transfer to the roller in order to limit the reduction in density on the recording surface. Therefore, an arrangement has been adopted in which spur like rollers having a smaller area of contact with the recording surface are used and extreme ends of their teeth portions are cleaned by a cleaner.

However, an effect of completely removing ink attached to the tooth ends of a spur-like roller has not been attained even by providing a cleaner in contact with the tooth ends for the purpose of preventing re-transfer of ink to the recording surface. If this method is used, retransfer to the recording surface of the recording member cannot be recognized with the human eye, but a very small amount of ink is attached to the discharge roller for discharging the recording member after recording when the discharge roller contacts the tooth ends of the spur-like roller after discharging. Accordingly, with the increase in the number of recording sheets, the amount of ink attached to the discharge roller becomes larger, and there is a risk of the surface of the recording member on the discharge roller side (the reverse surface opposite from the recording surface) being seriously contaminated by the attached ink. In particular, in the case of an overhead projector (OHP) sheet, a contamination on the reverse surface can be recognized as definitely as a contamination on the obverse surface when projected, and it is possible that the durability of the apparatus, i.e., the number of sheets used for recording by continuously operating the apparatus without maintenance, must be limited. If an ink having improved water fastness is used, the durability may be considerably reduced because such an ink has high adhesion and fastening properties in comparison with ordinary ink.

SUMMARY OF THE INVENTION

In view of the above-described problems of the conventional art, an object of the present invention is to provide a recording medium transport mechanism which has a spur member provided downstream of a recording section and a discharge roller capable of contacting the spur member, and which is arranged to prevent a contamination on the reverse surface of a recording medium, and also to provide an ink jet recording apparatus using the recording medium transport mechanism.

Another object of the present invention is to provide a recording medium transport mechanism which has a spur member provided downstream of a recording section and a discharge roller capable of contacting the spur member, which is arranged to prevent a contamination on the reverse surface of a recording medium, which is provided with a cleaner member to be brought into contact with the spur member, and which is arranged to improve the durability of the cleaner member and the cleaning effect, and also to provide an ink jet recording apparatus using the recording medium transport mechanism.

Yet another object of the present invention is to provide a recording medium transport mechanism in which a cleaning member is brought into contact with a rotary discharge member on the recording surface side of a recording medium in a pair of rotary discharge members for discharging the recording medium after recording by ejecting ink onto the recording medium and positioned downstream of the recording section, which has a liquid retaining member provided in an outer circumferential portion of the other rotary member opposite from the recording surface side so as to contact the rotary member on the recording surface side, and in which when the recording medium is discharged, a very small amount of ink remaining on the rotary member on the recording surface side is absorbed in the liquid retaining member, whereby a contamination on the reverse surface of the recording medium is prevented, and also to provide an ink jet recording apparatus using the recording medium transport mechanism.

Still another object of the present invention is to provide a recording medium transport mechanism in which when a recording medium is discharged, a pair of rotary discharge members are rotated in the normal direction and then in the reverse direction to increase the effect of cleaning a portion of the rotary member on the recording surface side which contacts the recording medium, and also to provide an ink jet recording apparatus using the recording medium transport mechanism.

A further object of the present invention is to provide a recording medium transport mechanism in which a rotary member on the recording surface side in a pair of rotary discharge members, a cleaner member contacting the rotary member on the recording surface side, and the other rotary member on the side opposite from the recording surface side have different circumferential lengths, whereby the relative positions between the rotary member on the recording surface side and the cleaner in contact with each other and the relative positions between the rotary member on the recording surface side and the rotary member on the side opposite from the recording surface side in contact with each other are varied during the rotation of these members to increase the duration of the effect of cleaning the rotary members, and also to provide an ink jet recording apparatus using the recording medium transport mechanism.

Still a further object of the present invention is to provide a recording medium transport mechanism in which if the height of an ink droplet ejected onto a recording medium and in contact with a rotary member on the recording surface side in a pair of rotary discharge members is L, the distance through which the rotary member on the recording surface side and a cleaner member contact each other is A and the distance through which the rotary member on the recording surface side and a liquid retaining member provided on the rotary member on the side opposite from the recording surface side contact each other is B, then $L<A$ and $L<B$ and, preferably, $L<A<B$ are satisfied, in which attached ink having a height equal to the height of contact between the ink droplet ejected onto the recording medium and the rotary member on the recording surface side is cleaned by the cleaning member through an area larger than the attachment area, and in which the rotary member on the recording surface side and the liquid retaining member are made to contact each other by a distance larger than the distance by which the rotary member on the recording surface and the cleaner member contact each other, whereby the contact portion of the rotary member on the recording surface side cleaned by the cleaner member is cleaned more effectively to achieve a markedly high cleaning effect, and also to provide an ink jet recording apparatus using the recording medium transport mechanism.

Still a further object of the present invention is to provide a recording medium transport mechanism for discharging out of a recording area a recording medium used for recording with ink ejected from an ink jet recording head, the recording medium transport mechanism comprising first rotary means provided downstream of the recording area in the direction of transport of the recording medium and on the side of a recording surface of the recording medium, and second rotary means provided downstream of the recording area and on the side opposite from the recording surface side of the recording medium to guide guiding the recording medium in association with the first rotary means to discharge the recording medium out of the recording area, the second rotary means including a liquid absorbing member provided in its circumferential surface portion and capable of contacting the first rotary means.

Still a further object of the present invention is to provide an ink jet recording apparatus having a recording medium transport mechanism for discharging out of a recording area a recording medium used for recording with ink ejected from an ink jet recording head, the ink jet recording apparatus comprising a head holding member for holding the ink jet recording head so that an ink ejection outlet faces a recording surface of the recording medium in the recording area, first rotary means provided downstream of the recording area in the direction of transport of the recording medium and on the recording surface side of the recording medium, and second rotary means provided downstream of the recording area and on the side opposite from the recording surface side of the recording medium to guide the recording medium in association with the first rotary means to discharge the recording medium out of the recording area, the second rotary means including a liquid absorbing member provided in its circumferential surface portion and capable of contacting the first rotary means.

DESCRIPTION OF THE PREFERRED EMBODIMENTS

Figure 1:
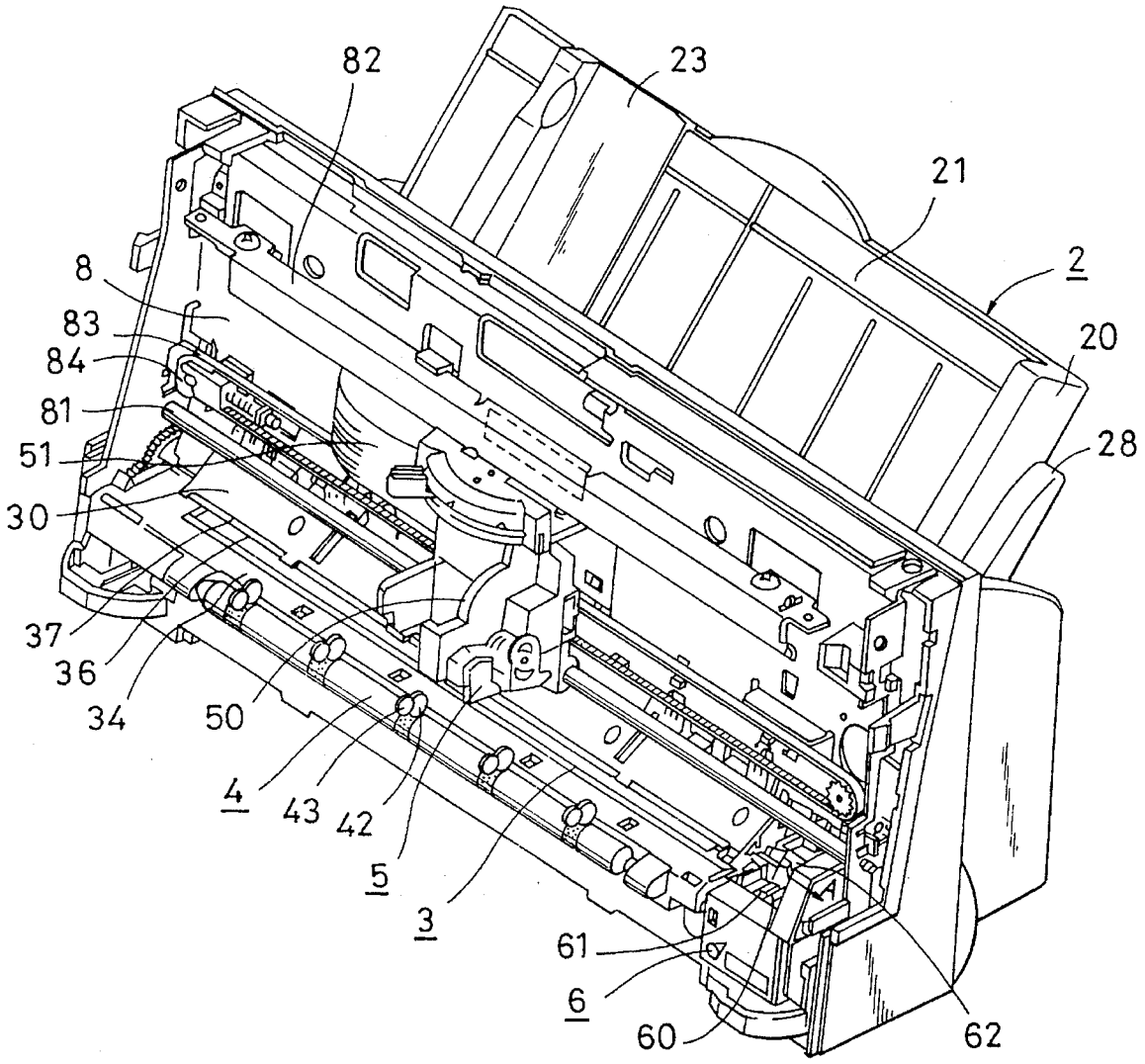
FIG. 1 is a schematic perspective view of an ink jet recording apparatus in accordance with a first embodiment of the present invention.
Figure 2:
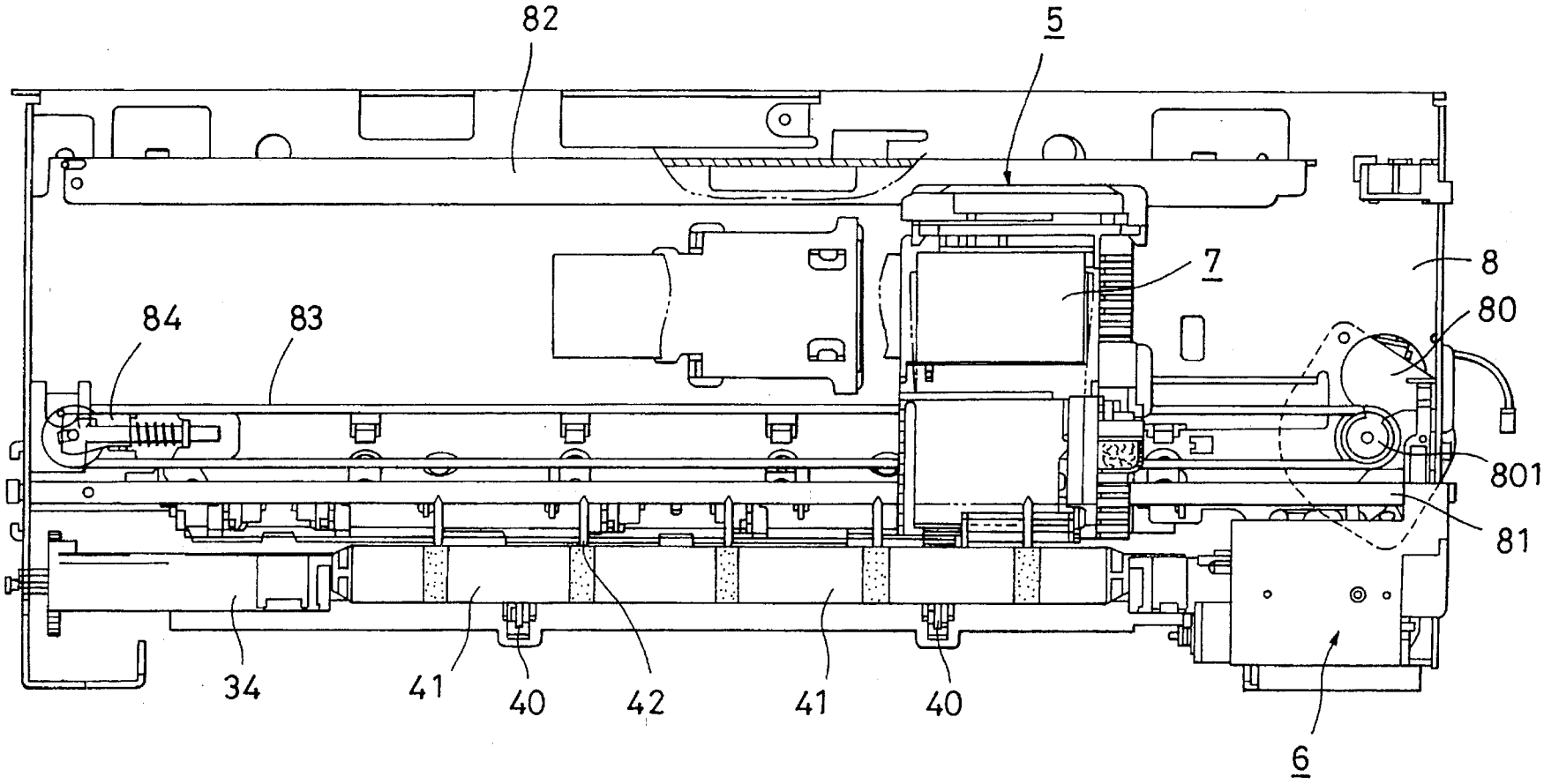
FIG. 2 is a schematic front view of the ink jet recording apparatus shown in FIG. 1.
Figure 3:
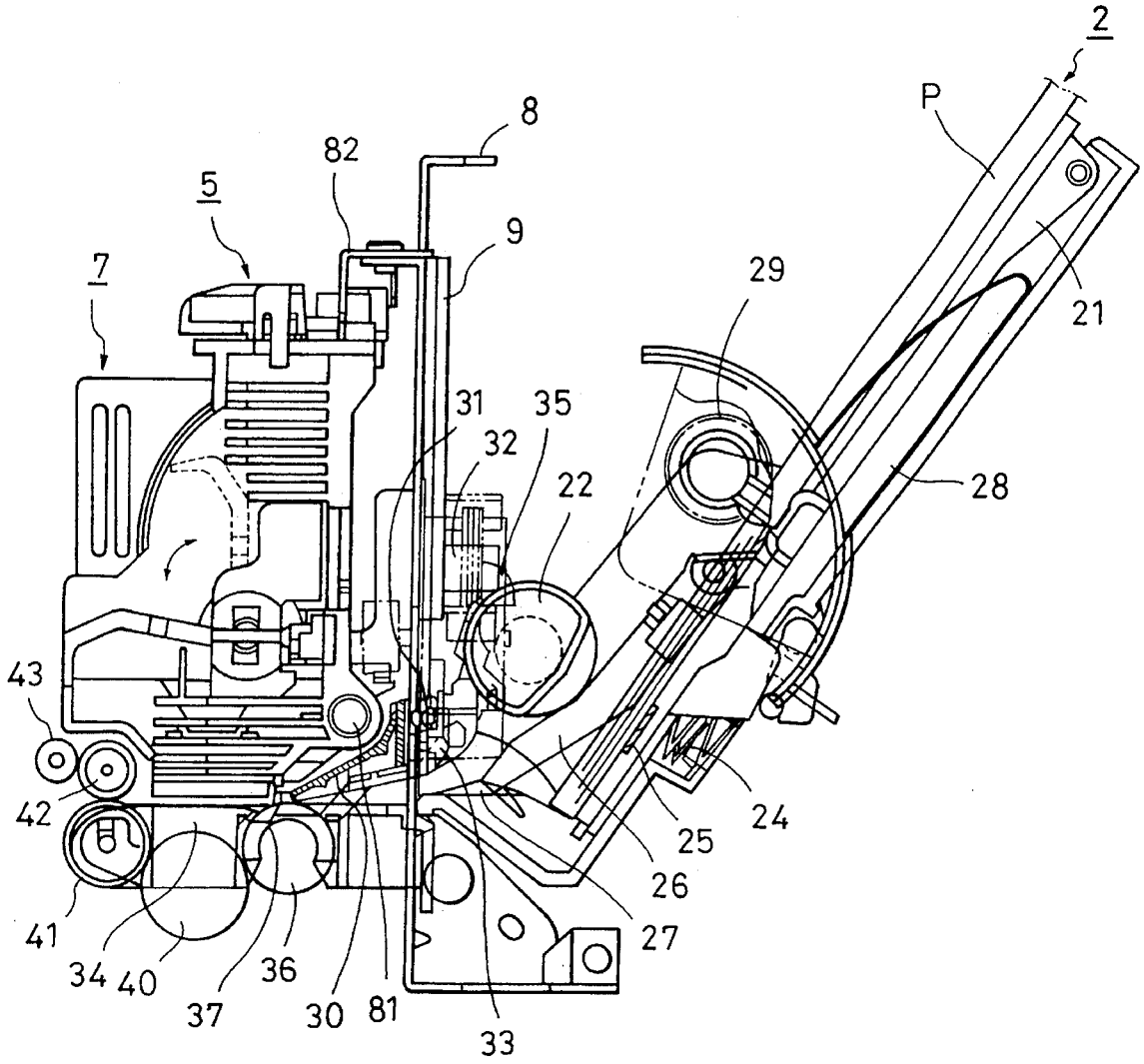
FIG. 3 is a schematic transverse sectional view of the ink jet recording apparatus shown in FIG. 1.

The preferred embodiments of the present invention will be described in detail with reference to the accompanying drawings.

An ink jet recording apparatus in accordance with the embodiments of the present invention has a feed section for feeding sheets of paper provided as recording members, a sheet transport section, a sheet discharge section, a recording head for ejecting ink toward each sheet of paper, i.e., each recording member, a carriage unit on which the recording head is mounted, and a cleaning section for cleaning the head. Features of the present invention reside in the structure of the discharge section. The discharge section has at least a pair of rotary discharge member assemblies, i.e., a discharge roller positioned on the side opposite from the recording surface side and spurs provided as a pressure contact roller assembly maintained in contact with the discharge roller by being pressed against the same, and a cleaner brought into contact with the pressure contact rollers to clean the same. A sheet of paper, i.e., a recording member (or sheet member made of a synthetic resin or the like (OHP sheet)) is transported between the discharge roller and the pressure contact rollers to be discharged. Ink on the recording surface in contact with the pressure contact rollers is not completely dried when transported between the discharge roller and the pressure contact rollers, attaches to the pressure contact rollers and is wiped off by the cleaner. The following is the problem to be solved by the present invention described below in detail with respect to the embodiments. Ink attached to the pressure contact rollers can be removed by the cleaner to prevent occurrence of recognizable retransfer to the recording surface. However, the pressure contact rollers contact the discharge roller by being pressed against the same during the period of time between discharging and feeding and, at this time, ink remaining on the pressure contact rollers is transferred onto the discharge roller, although the amount of this remaining ink is very small. With the increase in the number of recording sheets, transferred ink is accumulated on the outer circumferential surface of the discharge roller, thereby contaminating the reverse surface opposite from the recording surface of the recording member. If an ink having improved water fastness is used, this problem is particularly serious because such an ink has bad adhesion and fastening properties in comparison with ordinary ink.

In the embodiments described below, a sponge having a high water absorbing property may be preferably used as a liquid retaining member. A polyurethane microporous sponge is particularly preferred because it has a high rate of absorption from the surface. If the surface portion of the discharge roller formed by the liquid retaining member is recessed relative to the other surface portion, the water absorbing power of the liquid retaining member can be smaller than the absorbing power required when the surface is not recessed. In such a case, therefore, a urethane foam or rubber sponge compressed to ⅓ to 1/10 may be used to reduce the manufacturing cost.

In case where only circumferential surface portions at the pressure contact portions of the discharge roller are formed of the liquid retaining member, the width of the liquid retaining member is, preferably, 2 mm to 10 mm, and the thickness of the liquid retaining member is, preferably, 1 mm to 5 mm. If the width of the liquid retaining member is excessively small, it is difficult to position the liquid retaining member relative to the corresponding contact member. The width may be larger then the above-mentioned value, and the entire surface of the discharge roller may be covered with the liquid retaining member. If the thickness of the liquid retaining member is excessively small, the water absorbing power in the direction of thickness is insufficient. If the thickness is excessively large, the hardness of the liquid retaining member is limited.

In a case where the outside diameter of the outer circumferential portions formed of the liquid retaining member is reduced relative to that of the other outer circumferential portions, it is preferable to set the depth of the recess to about 0.1 mm to 5 mm and the width to about 3 mm to 5 mm. If the depth of the recess is excessively small, the effect of preventing contact between the reverse surface of the recording member and the liquid retaining member cannot be achieved. If the depth of the recess is excessively large, the recording medium is deformed by the pressure of pressing the pressure contact roller at the recess, resulting in an increase in cockling and a deterioration in printing quality. In a case where the entire surface of the discharge roller is formed of the liquid retaining member and where the outer surface is covered with a cover member so that only the contact portions are exposed, the width of the exposed portions may be set to the same value as mentioned above. The cover member may be a film of a plastic, such as polyester, a rubber sheet or the like. If the transporting force is considered, a rubber sheet is preferred. Each of the above-mentioned numerical values is selected with respect to the value of the outside diameter of the discharge roller in the range of about 10 mm to 20 mm. If the outside diameter of the discharge roller is changed, the size of the liquid retaining member may be adjusted as desired. The shape and other factors of the liquid retaining member may also be adjusted with respect to the contact pressure.

In the embodiments of the present invention, the discharge roller is rotated in the normal direction and then in the reverse direction after discharging the recording medium, thereby reliably cleaning the extreme ends of the pressure contact rollers with the cleaner and the liquid retaining member. Further, the liquid retaining member of the discharge roller, the pressure contact rollers and the cleaner may be formed so as to have different outer circumferential lengths in order that the positions of the pressure contact roller relative to the liquid retaining member and the cleaner in contact with each other can be always varied during rotation to maintain the desired effect of cleaning the pressure contact rollers. Moreover, the distances through which the pressure contact rollers contact the cleaners and the liquid retaining member are set so as to be larger than the distance through which the pressure contact rollers contact ink droplets on the recording surface, thereby obtaining an optimal cleaning effect.

In the embodiments of the present invention, the durability of the recording apparatus represented by the number of sheets used for recording by continuously operating the apparatus without maintenance can be increased to a sufficiently large number, and it is possible to maintain the cleaning effect of the pressure contact rollers by preventing a contamination on the reverse surface of the recording medium.

In the embodiments of the present invention, a recording system with a particular type of ink jet recording head is adopted in which recording is performed in such a manner that thermal energy is utilized to form a flying droplet of a liquid for recording. For example, as a typical example of such a system, a system based on the fundamental principles described in U.S. Pat. Nos. 4,723,129 and 4,740,796 is preferably used. This system can be applied to either of on-demand type and continuous type of recording apparatuses.

This recording system will be described briefly. At least one drive signal in accordance with recording information for causing such an abrupt increase in the temperature of a liquid (ink) as to cause film boiling exceeding a temperature at which nucleate boiling is caused is applied to an electrothermal transducer facing a sheet or a liquid channel containing the liquid (ink) to generate thermal energy in the electrothermal transducer, whereby film boiling is caused in the thermal action surface of the recording head. In this manner, a bubble can be formed in the liquid (ink) corresponding to the drive signal in a one-to-one relationship. Therefore, an application of this system based on an on-demand recording method is particularly effective. The liquid (ink) is ejected through an ejection outlet by the growth and contraction of such a bubble to form at least one liquid droplet. It is preferable to form the drive signal as a pulse-like signal, because a pulse-like drive signal can cause a bubble to grow and collapse instantaneously in a suitable manner so that the response of liquid (ink) ejection is improved. As such a pulse-like drive signal, a drive signal such as that described in of U.S. Pat. Nos. 4,463,359 or 4,345,262 is suited. If the condition of the rate of temperature rising at the above-mentioned thermal action surface described in U.S. Pat. No. 4,313,124 is adopted, the recording performance can be further improved.

The present invention also comprises, as a recording head structure, the arrangements disclosed in U.S. Pat. Nos. 4,558,333 and 4,459,600, wherein a thermal action portion is disposed in a bent area, as well as arrangements using a combination of an ejection outlet, a liquid passage and an electrothermal transducer, such as those disclosed in the specifications of the above-mentioned patents. The present invention is also advantageous even in the case of using a head structure based on the art disclosed in Japanese Laid-Open Patent Publication No. 123670/1984, which discloses an arrangement using a common slit as an ejection outlet for plural electrothermal transducers, and Japanese Laid-Open Patent Publication No. 138461/1984, which discloses an arrangement in which an opening for absorbing pressure waves of thermal energy is formed in correspondence with an ejection section.

Further, in the embodiments of the present invention, a full-line type of recording head can also be used effectively which has a length corresponding to a maximum width of recording medium sheets usable in the image forming apparatus. Such a recording head may be constructed by combining a plurality of recording heads such as those disclosed in the specifications of the above-mentioned patents so as to satisfy the full-line length condition, or may be constructed as one integrally-formed recording head. The present invention is also effective with respect to an arrangement using an interchangeable chip type of recording head which can be electrically connected to the apparatus body and can be supplied with ink from the apparatus body when mounted in the apparatus body, and an arrangement using a cartridge type of recording head integrally combined with an ink tank.

It is preferable to add a recording head ejection recovery means, an auxiliary preparatory means and the like to ink jet recording apparatuses in accordance with the embodiments of the present invention, because the effect of the present invention can be further stabilized thereby. Such means are, for example, a means for capping the recording head, a cleaning means, a pressurization or attraction means, a means for preliminary heating using an electrothermal conversion type heating element, any other type of heating element or a combination of such heating elements, and a means for ejection in a preliminary ejection mode other than ejection for recording.

The present invention is also very effective when applied to a recording apparatus having at least one of a recording mode for multicolor recording in two or more colors and a recording mode for full-color recording using mixed colors, regardless of use of one integrally-constructed recording head or a combination of a plurality of recording heads, as well as for a recording apparatus having only a recording mode for recording in a popularly-used color such as black.

(Embodiment 1)

The first embodiment of the present invention will be described with reference to FIGS. 1 through 6. An ink jet recording apparatus 1 having an automatic sheet feeder has a feed section 2, a transport section 3, a discharge section 4, carriage section 5 and a cleaning section 6. These sections will be schematically described successively.

(A) Feed Section

In the feed section 2, a pressing plate 21 on which sheets P are stacked and a rotary feeding member 22 for feeding each sheet P are mounted on a base 20. A movable side guide 23 is movably provided on the pressing plate 21 to limit the stacked position of sheets P. The pressing plate 21 is swingable on a rotary shaft connected to the base 20 and is urged toward the rotary feeding member 22 by a pressing plate spring 24. A separating pad 25 formed of a material such as artificial leather having a large friction coefficient to prevent feeding of two or more sheets P in a superposed state is attached to a portion of the pressing plate 21 opposed to the rotary feeding member 22. On the base 20 are further provided a separating claw 26 for separating sheets P one by one, a bank portion 27 integrally formed on the base 20 to separate thick sheets or the like which cannot be separated with the separating claw 26, a change lever 28 for making the separating claw 26 operate when set in an ordinary sheet position and for inhibiting the operation of the separating claw 26 when set in a thick sheet position, and a release cam 29 for releasing the pressing plate 21 and the rotary feeding member 22 from the state of contacting each other.

In the thus-constructed feed section, the release cam 29 maintains the pressing plate 21 at a predetermined position by downwardly pressing the same in a standby state. The pressing plate 21 and the rotary feeding member 22 are thereby inhibited from contacting each other. If in this state a driving force of a transport roller 36 is transmitted to the rotary feeding member 22 and the release cam 29 through a gear or the like, the release cam 29 moves away from the pressing plate 21 to allow the pressing plate 21 to move upwardly until the rotary feeding member 22 is brought into contact with the uppermost sheet P. With the rotation of the rotary feeding member 22, the operation of taking and feeding sheets P is started. Each sheet P is separated by the separating claw 26 to be fed into the transport section 3. The rotary feeding member 22 and the release cam 29 rotate until the separated sheet P is fed into the transport section 3. Thereafter, the rotary feeding member 22 is again set in the standby state by being released from the contact with the recording sheet P, and the transmission of the driving force from the transport roller 36 is stopped.

(B) Transport Section

The transport section 3 has the transport roller 36 for transporting sheets P and a paper sensor 32. Follower pinch rollers 37 are provided in contact with the transport roller 36. The pinch rollers 37 are held on a pinch roller guide 30. The pinch roller guide 30 is urged by a pinch roller spring 31 to press the pinch rollers 37 against the transport roller 36, thereby producing a force for transporting each sheet P. At an entrance to the transport section 3 through which transported sheet P is received, an upper guide 33 and a platen 34 for guiding each transported sheet P are disposed. A paper sensor lever 35 for transmitting movements of detecting leading and trailing ends of each sheet P to the paper sensor 32 is provided on the upper guide 33. A recording head 7 for forming an image on the basis of image information is provided downstream of the transport roller 36 in the recording sheet transport direction.

The recording head 7 is an ink jet recording head, which may be integrally combined with an ink tank or provided separately from an ink tank. In this embodiment, the recording head 7 has an electrothermal transducer and ejects ink through an ejection outlet by applying thermal energy to cause film boiling in ink and by utilizing changes in pressure caused by the growth and contraction of a bubble formed by film boiling.

In the thus-constructed transport section, sheet P fed to the transport section 3 is transported to the nips between the transport roller 36 and the pinch rollers 37 while being guided by the platen 34, the pinch roller guide 30 and the upper guide 33. At this time, the leading end of the transported sheet P is detected with the paper sensor lever 35, and a printing start position on sheet P is thereby determined. The sheet P is transported over the platen 34 by the rotation of the transporting roller 36 and in, he pinch rollers 37 caused by a line feed motor (not shown).

(C) Carriage Section

The carriage section 5 has a carriage 50 on which the recording head 7 is mounted. The carriage 50 is supported by a guide shaft 81 for reciprocative scanning in a direction perpendicular to the direction in which sheet P is transported and by a guide rail 82 for maintaining a gap between the recording head 7 and sheet P by supporting a rear end of the carriage 50. The guide shaft 81 and the guide rail 82 are attached to a chassis 8. The carriage 50 is driven through a timing belt 83 by a carriage motor 80 mounted on the chassis 8. The timing belt 83 is wrapped around and supported by idle pulleys 84 and 801. The carriage 50 has a flexible printed circuit board 51 for transmitting a head drive signal from an electric circuit board 9 to the recording head 7.

In the thus-constructed carriage section, when an image is formed on one sheet P, the transport roller 36 and pinch rollers 37 are operated to transport the sheet P to a position at which a line of the image is to be formed (a position along the sheet P transport direction), while the carriage 50 is moved to an image forming position (position along a direction perpendicular to the sheet P transport direction) to make the recording head 7 face the sheet P at the image forming position. Ink is ejected from the recording head 7 to the sheet P in accordance with the head drive signal from the electric circuit board 9 to form the image.

(D) Discharge Section

The discharge section 4 has a transmission roller 40 which contacts the above-described transport roller 36 and which also contacts a discharge roller 41. A driving force from the transport roller 36 is transmitted to the discharge roller 41 thorough the transmission roller 40. Spurs 42 which are rotatable by following the discharge roller 41 are pressed against the discharge roller 41. In this arrangement, sheet P on which an image is formed is transported by being pinched in the nips between the discharge roller 41 and the spurs 42 to be discharged onto a discharge tray (not shown).

Each spur 42 is formed into the shade of a toothed wheel having acute ends in order to reduce the area of contact with the ink ejected to form an image on sheet P. Cleaners 43 for cleaning the spurs 42 at the ends of the toothed shape are in contact with the spurs 42. The spurs 42, described as toothed wheels with respect to this embodiment, may alternatively be formed as beads such that their circumferential surface continuously contacts the sheet P surface. The material of the cleaners 43 is, preferably, a urethane microporous sponge having high absorbing power.

(E) Cleaning Section

The cleaning section 6 is constituted by a pump 60 for cleaning the recording head 7, a cap 61 for limiting drying of the recording head 7, and a drive change arm 62 for changing the path for transmission of the driving force from the transport roller 36 between the feed section 2 and the pump 60.

The discharge section 4 will now be described in more detail.

Figure 4:
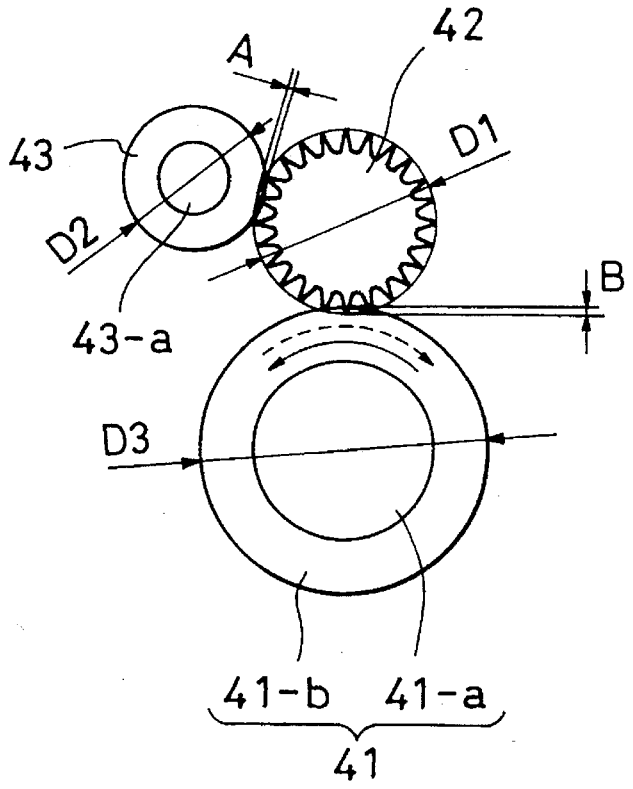
FIG. 4 is a schematic transverse sectional view of a state of contact between spur 42, cleaner 43 and roller 41.
Figure 5:
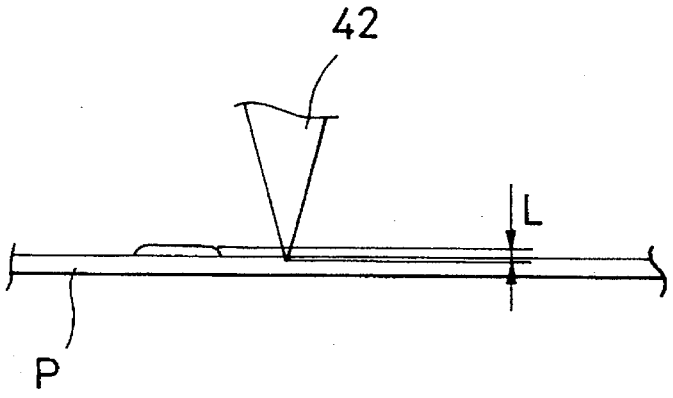
FIG. 5 is an enlarged view of an essential portion of FIG. 4.

Referring to FIG. 4 which is a cross-sectional view of the discharge section 4, the spurs 42 are pressed against the discharge roller 41 and rotate by following the rotation of the discharge roller 41. Extreme end portions of each spur 42 overlap water absorptive sponge members **41*b* forming circumferential portions of the discharge roller 41 by a distance B as shown in FIG. 4. The cleaners 43 having a water absorbing property and wrapped around a holder shaft 43*a* are provided at the side of the spurs 42 opposite from the discharge roller 41. The cleaners 43 are supported so as to be rotatable by following the spurs 42. Also in this case, the cleaners 43 are set so that the extreme end portions of the spurs 42 overlap the cleaners 43 by a distance A as shown in FIG. 4. FIG. 5 illustrates a state when an ink droplet is ejected onto sheet P and a state when the extreme end of each spur 42 is pressed against Sheet P. In such a situation, the extreme end of the spur 42 contacts ink through a distance of L as shown in FIG. 5. In this embodiment, the distance L shown in FIG. 5, which depends upon the material of sheet P and other conditions, is 0.03 mm to 0.08 mm, approximately. To increase the effect of cleaning the extreme ends of the spurs 42, the values A and B shown in FIG. 4** are selected so as to satisfy A>L and B L. More preferably, for a higher cleaning efficiency, these values are selected so as to satisfy a relationship B A>L.

In this embodiment, A is set within the range of 0.1 mm to 0.2 mm and B is set within the range of 0.2 mm to 0.3 mm. The outside diameter D1 of the spurs 42, the outside diameter D2 of the cleaners 43 and the outside diameter D3 of the discharge roller 41 are set to different values and, accordingly, the spurs 42 and the cleaners 43 have different outer circumferential lengths. Therefore, the extreme ends of each spur 42, during certain revolutions, after being brought into contact with certain portions of the outer circumferential surface of each of the cleaner 43 or the discharge roller 41 by a first revolution of the spur 42, are brought into contact with different portions of the outer circumferential surface of the cleaner 43 or the discharge roller 41 by second and other revolutions of the spur 42.

That is, the acute extreme ends of each spur 42 capable of contacting the cleaner 43 and the discharge roller 41 are brought into contact with each of the cleaner 43 and the discharge roller 41 at different positions as the spur 42 rotates, thereby preventing a local deterioration in the absorbing power of the cleaner 43 and the water absorptive sponge **41*b*** and maintaining the desired water absorbing property of each member.

Figure 6:
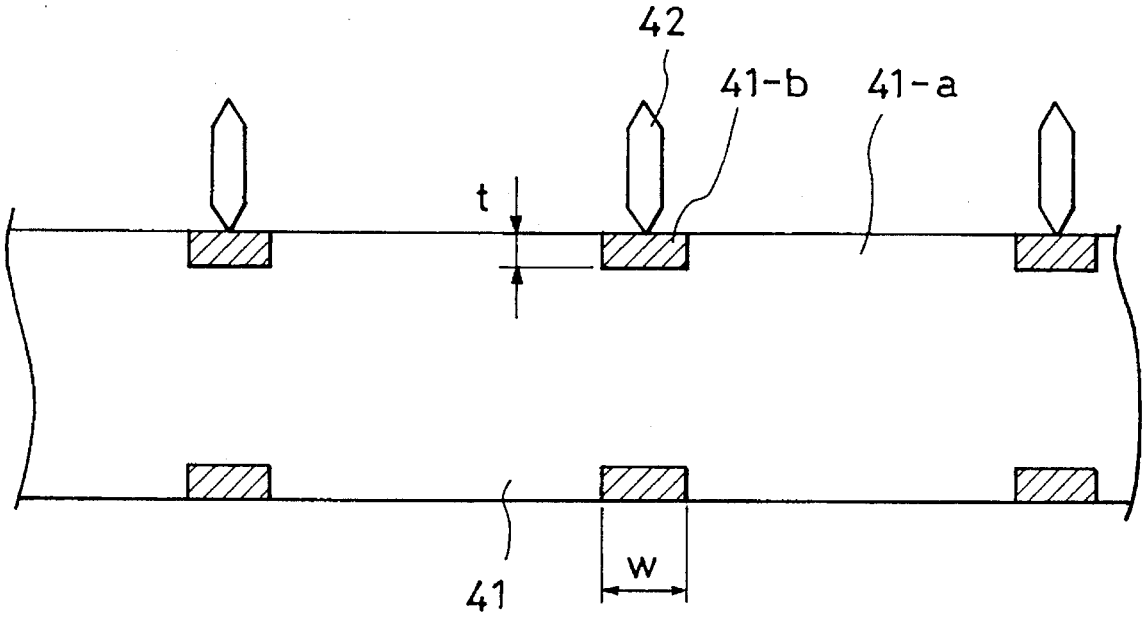
FIG. 6 is a schematic fragmentary longitudinal sectional view of a rotary discharge member (discharge roller) with a liquid retaining member and pressing members (spurs) shown in the first embodiment.

In the discharge roller 41, as illustrated in FIG. 6, the sponge members **41*b* having water absorptive property are wrapped around circumferential portions of a discharge roller holder 41*a* (made of a plastic) to be brought into contact with the spurs 42. Preferably, the width w of the sponge members is within the range of 2 mm to 10 mm and the thickness t of the sponge members is within the range of 1 mm to 5 mm. It is also preferred that the outside diameter D3 and the length of the discharge roller 41 are about 15 mm and about 210 nun, respectively, and the outside diameter D1 and the width of each spur 42** are about 10 mm and about 2 mm, respectively.

The discharge operation based on the above-described arrangement will be described below. The direction of rotation for discharging sheets is indicated by the solid line arrow in FIG. 4.

An ink droplet ejected onto sheet P for image formation is brought into contact with the extreme ends of one of the spurs 42 before it dries completely. At this time, a small amount of ink attaches to some of the extreme ends of the spur 42 and is removed by the water absorptive cleaner 43. This operation is repeated during discharge of sheet P. When the trailing end of one sheet P moves out of the nip between the spurs 42 and the discharge roller 41, the spurs 42 are brought into contact with the water absorptive sponge members 41*b* of the discharge roller 41. With further rotation of the discharge roller 41 in the normal direction, the extreme ends of the spur 42 are further cleaned by the water absorptive sponge 41*b*. Since a polyurethane microporous sponge having a high water absorbing property is used as water absorptive sponge 41-*b*, ink is not accumulated on the outer circumferential surface of the water absorptive sponge 41-*b*, thereby preventing ink from contaminating the reverse surface of sheet P. Moreover, the discharge roller 41 is rotated in the reverse direction (in the direction of the broken line arrow in FIG. 4) to doubly increase the cleaning effect of the cleaner 43 and the water absorptive sponge 41-*b*. The amount of this reverse rotation of the discharge roller 41 may be equal to or larger than a value corresponding to one revolution of the spurs 42. The operation of rotating the discharge roller 41 in the normal and reverse directions as described above may be repeated several times to further increase the cleaning effect.

(Embodiment 2)

Figure 7:
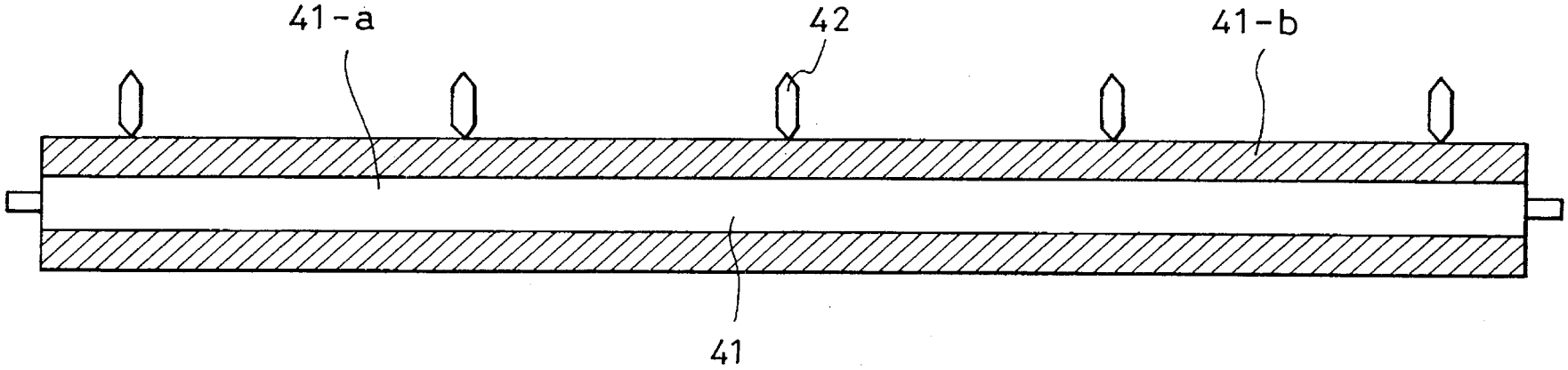
FIG. 7 is a schematic longitudinal sectional view of a rotary discharge member (discharge roller) with a liquid retaining member and pressing members (spurs) shown in a second embodiment of the present invention.

The second embodiment of the present invention will be described with reference to FIG. 7.

Discharge roller 41 has sponge 41-*b* integrally formed around a core 41-*a* (made of a metal).

Also in this embodiment, spurs 42 are brought into contact with the sponge after discharging sheet P to enable the sponge to absorb a small amount of ink attached to extreme ends of spurs 42, thus cleaning the extreme ends of spurs 42 by the sponge.

(Embodiment 3)

Figure 8:
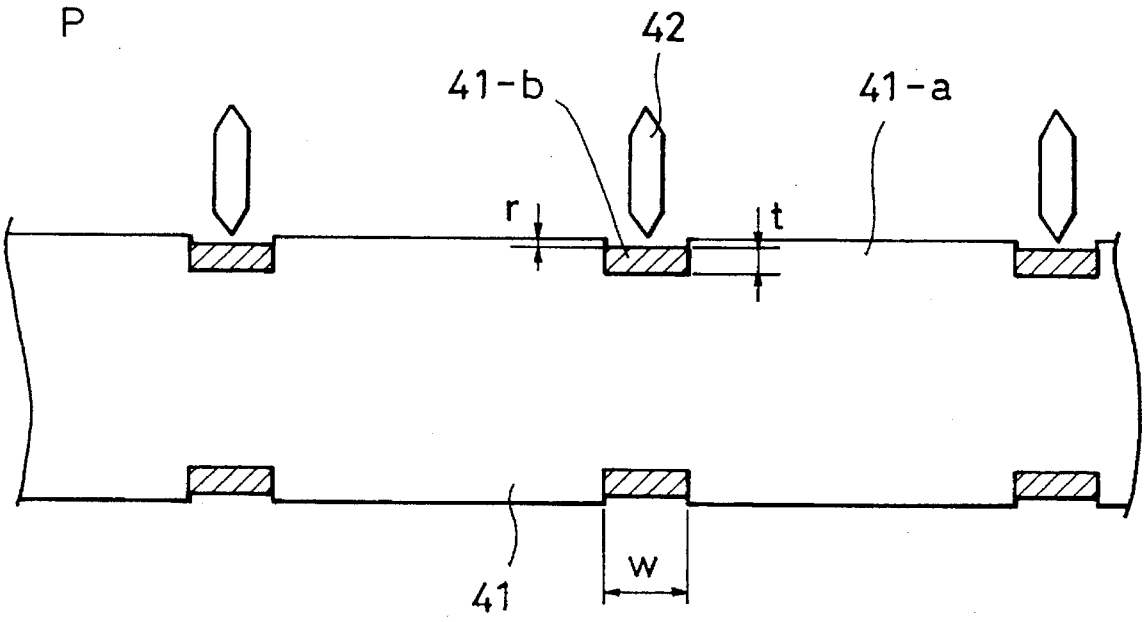
FIG. 8 is a schematic longitudinal sectional view of a rotary discharge member (discharge roller) with a liquid retaining member and pressing members (spurs) shown in a third embodiment of the present invention.

The third embodiment of the present invention will be described with reference to FIG. 8.

In discharge roller 41, sponge 41-b is wrapped around circumferential portions of discharge roller holder 41-a of discharge roller 41 to be brought into contact with spurs 42, as in the case of Embodiment 1. The radius of the outer surface portions of discharge roller 41 formed by sponge 41-*b* is smaller by r than the radius of the remaining outer surface of discharge roller holder 41-*a*. Preferably, the value of r is within the range of 0.1 mm to 0.5 mm, and the width w is within the range of 3 mm to 5 mm.

Also in this embodiment, spurs 42 are brought into contact with the sponge after discharging sheet P to enable the sponge to absorb a small amount of ink attached to extreme ends of spurs 42, thus cleaning the extreme ends of spurs 42 by the sponge. This embodiment has a further advantage as described below. When sheet P is transported, the outer circumferential surface of sponge 41-b does not contact the reverse surface of sheet P because the sponge 41-*b* is recessed by a distance r relative to the discharge roller holder 41-*a*. Therefore, it is not necessary to use a material having a particularly a high water absorbing property as the above-described sponge, and it is possible to use, for example, a urethane foam or rubber sponge compressed at a high rate as a liquid retaining member.

(Embodiment 4)

Figure 9:
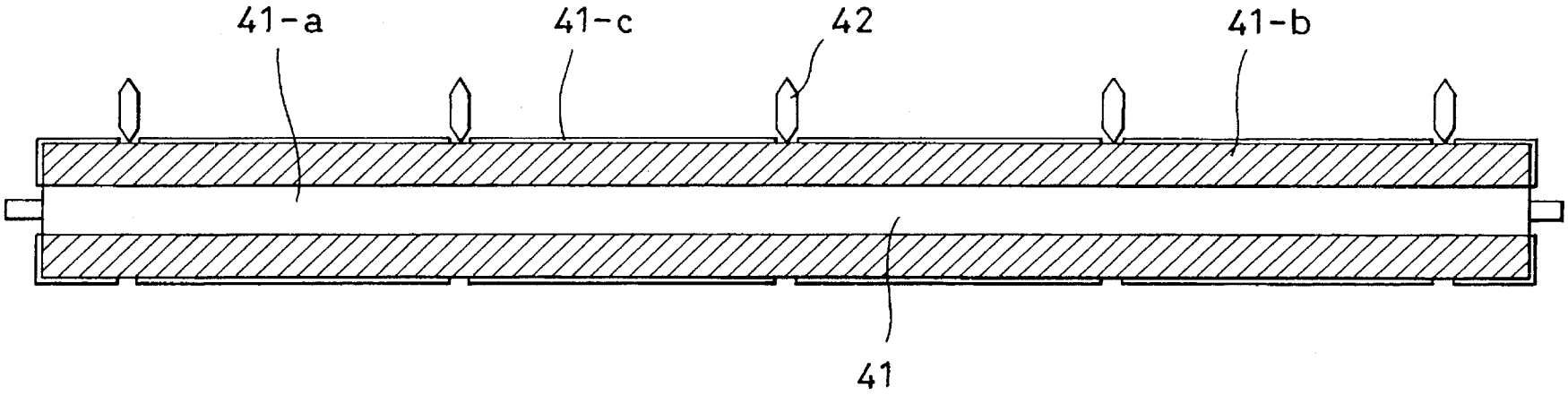
FIG. 9 is a schematic longitudinal sectional view of a rotary discharge member (discharge roller) with a liquid retaining member and pressing members (spurs) shown in a fourth embodiment of the present invention.

The fourth embodiment of the present invention will be described with reference to FIG. 9.

Discharge roller 41 has sponge 41-*b* integrally formed around a core 41-*a*, and cover members 41-*c* for covering portions of the sponge 41-*b* other than the portions to be brought into contact with spurs 42. The value of r is set within the range of 0.1 mm to 0.5 mm and the width w is set within the range of 3 mm to 5 mm, as in Embodiment 3.

Also in this embodiment, spurs 42 are brought into contact with the sponge after discharging sheet P to enable the sponge to absorb a small amount of ink attached to extreme ends of spurs 42, thus cleaning the extreme ends of spurs 42 by the sponge. Further, it is not necessary to use a material having a particularly high water absorbing property as the above-described sponge because the sponge 41-b is recessed by a distance r relative to the discharge roller holder 41-*a* so that the outer circumferential surface of sponge 41-*b* does not contact the reverse surface of sheet P when sheet P is transported.

As described above, in the ink jet recording apparatus in accordance with each embodiment of the present invention, cleaning members are brought into contact with the rotary discharge members on the recording surface side of the recording medium in the pair of rotary discharge member assemblies and positioned downstream of the recording section, and liquid retaining members are provided in outer circumferential portions of the other rotary member on the opposite side, whereby a contamination on the reverse surface of the recording medium caused by ink attached to the rotary member on the recording surface side, which cannot be completely removed in the conventional apparatus, can be prevented.

The pair of rotary discharge member assemblies are rotated in the normal direction and then in the reverse direction to increase the effect of cleaning the rotary member assembly on the recording surface side with the cleaning members and the rotary member on the side opposite from the recording surface side.

The pair of rotary member assemblies and the cleaning members are formed so as to have different circumferential lengths, thereby maintaining effect of cleaning the rotary members on the recording surface side by the cleaning members and the rotary member on the side opposite from the recording surface side.

Further, the distance through which the rotary members on the recording surface side and cleaning members contact each other and the distance through which the rotary members on the recording surface side the rotary member on the side opposite from the recording surface side contact each other are set so as to be larger than the distance through which the rotary members on the recording surface side contact the ink ejected onto the recording member, whereby the cleaning members and the liquid retaining members contact the rotary members always more widely in comparison with the area of the portions of the rotary members brought into contact with ink. It is therefore possible to increase the effect of cleaning the contact surfaces of the rotary members on the recording surface side.

Thus, the present invention makes it possible to improve the effect of cleaning the rotary members on the recording surface side and the duration of that effect as well as to prevent a contamination on the reverse surface of the recording medium. The above-described effects are remarkable particularly when an ink having improved water fastness is used.

While the present invention has been described with respect to what is presently considered to be the preferred embodiments, it is to be understood that the invention is not limited to the disclosed embodiments. The present invention is intended to cover the various modifications and equivalent arrangements included within the spirit and scope of the appended claims.

What is claimed is:

1. A recording medium transport mechanism for discharging from a recording area a recording medium used for recording with ink ejected from an ink jet recording head, said recording medium transport mechanism comprising:

first rotary means provided downstream of the recording area in a direction of transport of the recording medium and on a side of a recording surface of the recording medium; and second rotary means provided downstream of the recording area and on the side opposite from the recording surface side of the recording medium, said second rotary means for guiding the recording medium in association with said first rotary means to discharge the recording medium out of the recording area, said second rotary means including a liquid absorbing member provided on its circumferential surface portion and capable of contacting said first rotary means.

2. A recording medium transport mechanism according to claim 1, wherein said first rotary means comprises a spur member having plurality of projections arranged on its circumferential surface, said projections being capable of being brought into contact with said second rotary means.

3. A recording medium transport mechanism according to claim 1, wherein said first rotary means contacts a cleaner member provided downstream of the recording area in the direction of transport of the recording medium and on the recording surface side of the recording medium.

4. A recording medium transport mechanism according to claim 3, wherein circumferential surfaces of said first rotary means and said cleaner member which contact each other have different lengths.

5. A recording medium transport mechanism according to claim 3, wherein if a height of an ink droplet ejected onto the recording surface of the recording medium is L, an amount of biting of said first rotary means when said first rotary means and said cleaner member contact each other is A and an amount of biting of said first rotary means when said first rotary means and said second rotary means contact each other is B, then $L<A$ and $L<B$ are satisfied.

6. A recording medium transport mechanism according to claim 3, wherein if a height of an ink droplet ejected onto the recording surface of an recording medium is L, the amount of biting of said first rotary means when said first rotary means and said cleaner member contact each other is A and an amount of biting of said first rotary means when said first rotary means and said second rotary means contact each other is B, then $L<A<B$ is satisfied.

7. A recording medium transport mechanism according to claim 1, wherein said liquid absorbing member is formed of open cell urethane foam processed so as to have a hydrophilic property.

8. A recording medium transport mechanism according to claim 1, wherein after discharging the recording medium, said first and second rotary means make at least one revolution in the direction opposite to the direction of transport of the recording medium before a next recording medium is transported to said first and second rotary means.

9. A recording medium transport mechanism according to claim 1, wherein circumferential surfaces of said first and second rotary means which contact each other have different lengths.

10. A recording medium transport mechanism according to claim 1, further comprising the ink jet recording head, wherein said ink jet recording head comprises an electrothermal transducer for generating thermal energy utilized to eject ink.

11. An ink jet recording apparatus for discharging from a recording area a recording medium used for recording with ink ejected from an ink jet recording head, said ink jet recording apparatus comprising:

a head holding member for holding the ink jet recording head so that an ink ejection outlet faces a recording surface of the recording medium in the recording area;

first rotary means provided downstream of the recording area in a direction of transport of the recording medium and on the recording surface side of the recording medium; and second rotary means provided downstream of the recording area and on the side opposite from the recording surface side of the recording medium, said second rotary means for guiding the recording medium in association with said first rotary means to discharge the recording medium out of the recording area, said second rotary means including a liquid absorbing member provided on its circumferential surface portion and capable of contacting said first rotary means.

12. An ink jet recording apparatus according to claim 11, wherein said first rotary means comprises a spur member having plurality of projections arranged on its circumferential surface, said projections being capable of being brought into contact with said second rotary means.

13. An ink jet recording apparatus according to claim 11, wherein said first rotary means contacts a cleaner member provided downstream of the recording area in the direction of transport of the recording medium and on the recording surface side of the recording medium.

14. An ink jet recording apparatus according to claim 13, wherein circumferential surfaces of said first rotary means and said cleaner member which contact each other have different lengths.

15. An ink jet recording apparatus according to claim 13, wherein if a height of an ink droplet ejected onto the recording surface of the recording medium is L, an amount of biting of said first rotary means when said first rotary means and said cleaner member contact each other is A and an amount of biting of said first rotary means when said first rotary means and said second rotary means contact each other is B, then $L<A$ and $L<B$ are satisfied.

16. An ink jet recording apparatus according to claim 13, wherein if a height of an ink droplet ejected onto the recording surface of the recording medium is L, an amount of biting of said first rotary means when said first rotary means and said cleaner member contact each other is A and the amount of biting of said first rotary means when said first rotary means and said second rotary means contact each other is B, then $L<A<B$ is satisfied.

17. An ink jet recording apparatus according to claim 11, wherein said liquid absorbing member is formed of open cell urethane processed so as to have a hydrophilic property.

18. An ink jet recording apparatus according to claim 11, wherein after discharging the recording medium, said first and second rotary means make at least one revolution in the direction opposite to the direction of transport of the recording medium before a next recording medium is transported to said first and second rotary means.

19. An ink jet recording apparatus according to claim 11, wherein circumferential surfaces of said first and second rotary means which contact each other have different lengths.

20. An ink jet recording apparatus according to claim 11, further comprising the ink jet recording head, wherein said ink jet recording head comprises an electrothermal transducer for generating thermal energy utilized to eject ink.

21. An ink jet recording apparatus according to claim 11, wherein only an outer circumferential portion of said second rotary means which contacts said first rotary means is formed of the liquid absorbing member.

22. An ink jet recording apparatus according to claim 21, wherein the width of the liquid absorbing member is within the range of 2 mm to 10 mm, and the thickness of the liquid absorbing member is within the range of 1 mm to 5 mm.

23. An ink jet recording apparatus according to claim 11, wherein the entire outer circumference of said second rotary means is formed of the liquid absorbing member.

24. An ink jet recording apparatus according to claim 23, wherein the width of the liquid absorbing member is within the range of 1 mm to 5 mm.

25. An ink jet recording apparatus according to claim 11, wherein an outside diameter of an outer circumferential portion of said second rotary means which contacts said first rotary means and which is formed of the liquid absorbing member is smaller than the outside diameter of the remaining circumferential portion of said second rotary means.

26. An ink jet recording apparatus according to claim 25, wherein the width of the liquid absorbing member is within the range of 3 mm to 5 mm, the thickness of the liquid absorbing member is within the range of 1 mm to 5 mm, and the difference between the outside diameter of the outer circumferential portion formed by the liquid absorbing member and the outside diameter of the remaining circumferential portion is within the range of 0.1 mm to 0.5 mm.

27. An ink jet recording apparatus according to claim 11, wherein only an outer circumferential portion of said second rotary means which contacts said first rotary means is exposed and the remaining circumferential portion of said second rotary means is covered with a cover member.

28. An ink jet recording apparatus according to claim 27, wherein the thickness of the cover member is within the range of 0.1 mm to 0.5 mm, and the width of the exposed portion is within the range of 3 mm to 5 mm.

* * * * *

UNITED STATES PATENT AND TRADEMARK OFFICE

CERTIFICATE OF CORRECTION

PATENT NO. : 5,567,069 Page 1 of 2

DATED : October 22, 1996

INVENTOR(S) : Tetsuo SUZUKI, et al.

It is certified that error appears in the above-indentified patent and that said Letters Patent is hereby corrected as shown below:

On title page,

AT [56] References Cited - U.S. PATENT DOCUMENTS:

the following documents should be listed:

| | | | |
|---|---|---|---|
| --4,212,555 | 7/1980 | Rosenstock | 400/641 |
| 5,329,302 | 7/1994 | Fogle et al. | 400/648 |
| 5,356,231 | 10/1994 | Nakamura et al. | 400/625--. |

COLUMN 1:

Line 23, "meter" should read --member--.

COLUMN 9:

Line 9, "in, he" should read --the--.

COLUMN 10:

Line 21, "B L." should read --B>L.--;
Line 23, "B A>L." should read --B>L>A.--;
Line 55, "nun," should read --mm,--.

UNITED STATES PATENT AND TRADEMARK OFFICE

CERTIFICATE OF CORRECTION

PATENT NO. : 5,567,069 Page 2 of 2

DATED : October 22, 1996

INVENTOR(S) : Tetsuo SUZUKI, et al.

It is certified that error appears in the above-indentified patent and that said Letters Patent is hereby corrected as shown below:

COLUMN 11:

Line 53, "a particularly a" should read --a particularly--.

COLUMN 13:

Line 37, "an recording medium" should read --the recording medium--, "the amount" should read --an amount--.

COLUMN 14:

Line 40, "the" should read --an--.

Signed and Sealed this

Twenty-second Day of April, 1997

Bruce Lehman

*Attest:*

BRUCE LEHMAN

*Commissioner of Patents and Trademarks*

*Attesting Officer*